US007316310B2

(12) United States Patent
Saschin

(10) Patent No.: US 7,316,310 B2
(45) Date of Patent: Jan. 8, 2008

(54) DEVICE FOR PACKAGING A PRODUCT IN THE FORM OF A SAMPLE

(75) Inventor: Ira Saschin, Karlsruhe (DE)

(73) Assignee: L'Oreal, Paris (FR)

( * ) Notice: Subject to any disclaimer, the term of this patent is extended or adjusted under 35 U.S.C. 154(b) by 152 days.

(21) Appl. No.: 10/855,337

(22) Filed: May 28, 2004

(65) Prior Publication Data

US 2005/0006275 A1 Jan. 13, 2005

Related U.S. Application Data

(60) Provisional application No. 60/484,283, filed on Jul. 3, 2003.

(30) Foreign Application Priority Data

May 28, 2003 (FR) ..... 03 06508

(51) Int. Cl.

| | |
|---|---|
| ***B65D 69/00*** | (2006.01) |
| ***B65D 73/00*** | (2006.01) |
| ***B65D 85/00*** | (2006.01) |
| ***A45D 44/00*** | (2006.01) |
| ***B42D 15/00*** | (2006.01) |

(52) U.S. Cl. ..... 206/232; 132/333; 206/459.5; 206/466; 206/581; 283/56

(58) Field of Classification Search ..... 206/232, 206/459.5, 466, 581, 730–734; 132/317, 132/320, 333; 283/56, 105–106
See application file for complete search history.

(56) References Cited

U.S. PATENT DOCUMENTS

| | | | | |
|---|---|---|---|---|
| 3,256,978 | A * | 6/1966 | Srigley et al. | 206/232 |
| 4,876,136 | A * | 10/1989 | Chang et al. | 132/320 |
| 4,890,872 | A * | 1/1990 | Parrotta et al. | 283/56 |
| 4,925,029 | A * | 5/1990 | Friedman et al. | 206/459.5 |
| 5,037,139 | A * | 8/1991 | Schoenleber et al. | 283/56 |
| 5,050,910 | A * | 9/1991 | Schechter et al. | 283/105 |
| 5,072,831 | A * | 12/1991 | Parrotta et al. | 206/232 |
| 5,160,022 | A * | 11/1992 | Mennella | 206/232 |
| 5,242,521 | A * | 9/1993 | Hibsch et al. | 283/105 |
| 5,984,092 | A * | 11/1999 | Heard-Willmon | 206/232 |
| 6,213,303 | B1 * | 4/2001 | Harris et al. | 206/581 |
| 6,688,467 | B2 * | 2/2004 | Krupka et al. | 206/581 |
| 6,722,495 | B2 * | 4/2004 | Fresnel | 206/232 |

FOREIGN PATENT DOCUMENTS

| | | | |
|---|---|---|---|
| DE | 3902911 | 8/1990 | |
| FR | 2422562 | 11/1979 | |
| FR | 2447328 | 8/1980 | |
| GB | 2266695 | * 11/1993 | 206/459.5 |

* cited by examiner

*Primary Examiner*—Bryon P Gehman
(74) *Attorney, Agent, or Firm*—Oblon, Spivak, McClelland, Maier & Neustadt, P.C.

(57) ABSTRACT

A device for packaging a product which can be included with an article, such as an article containing a first cosmetic product. The device includes a sachet containing a second product, in particular a sample cosmetic product, which may be the same as the first or different. In addition, a sheet is folded so as to delimit a compartment in which the sachet is accommodated, with the sheet including information relating to at least one of the first and second products. A packing assembly is also provided, which includes a package having a container therein for a first cosmetic product, with the folded sheet accommodating the sachet of a second cosmetic product also positioned in the package.

37 Claims, 4 Drawing Sheets

DEVICE FOR PACKAGING A PRODUCT IN THE FORM OF A SAMPLE

CROSS-REFERENCE TO RELATED APPLICATIONS

This document claims priority to French Application Number 03 06508, filed May 28, 2003 and U.S. Provisional Application No. 60/484,283, filed Jul. 3, 2003, the entire contents of which are hereby incorporated by reference.

FIELD OF THE INVENTION

The present invention relates to a device for packaging a product. The invention is particularly advantageous for packaging a sample, especially a cosmetic product sample.

BACKGROUND OF THE INVENTION

Discussion of Background

The term "cosmetic product" includes at least products as defined in Directive 93/35/EEC of 14 June 1993, amending Directive 76/768/EEC.

Cosmetic products such as care creams, for example, include a range of various creams intended for different applications. For example, in the case of anti-wrinkle creams, a range of products are available, including a day cream, a night cream, a cream for the contours of the eyes, etc. When one of the products in such a range is being retailed, it may be advantageous to include a sample of another product in the same range, so as to make the user aware of the entire range or line of products. Such a commercial operation or offering, however, should not entail too much additional cost.

Furthermore, where a product is distributed in the form of a sample, it should preferably be distributed with a certain amount of information relating to the product. In particular, certain statutory labeling must necessarily be shown, such as a list of the product's ingredients. However, a sample of product is by definition a relatively small dose of product, which is therefore packaged in a small holder on which it is difficult to write all the required information. The information therefore needs to be written on a separate element, which makes handling of such a sample more complicated, particularly when the sample is intended to be combined with a retail product or product being sold in the packaging/assembly line for the product being sold.

SUMMARY OF THE INVENTION

It is therefore one of the objects of the invention to provide a device for packaging a product in the form of a sample, which makes it possible to indicate all the necessary information relating to the product.

It is another object of the invention to provide a device which is simple and inexpensive to produce.

It is yet another object of the invention to provide a device which is easy to handle on a packaging line.

Other objects and advantages will become apparent from the description herein.

According to the invention, the above objects are achieved by providing a device for packaging a product in the form of a sample which may be included with an article, such as an article for sale. According to a preferred example, an article (e.g., an article being sold) includes a first cosmetic product, and the device includes a sachet containing a second product, such as a cosmetic product, which may be the same as the first or different. A sheet is folded so as to delimit a compartment in which the sachet is accommodated, with the sheet having information relating to at least one of the first and second products.

Since the sheet with information relating to the product can be used to accommodate the sachet containing the dose of sample product, a product sample can be obtained which is compact but nevertheless includes all the necessary information in order for this sample to be distributed. In addition, because the sheet and the sachet are two separate elements, they can also be produced separately from each other in a conventional way and inexpensively. The sample can furthermore be handled with ease, since there need only be one element to handle. When enclosed by a sheet, the sachet can also be easier to handle than a sachet by itself.

The shape of the compartment may be substantially identical to the shape of the sachet, so that the sachet is held perfectly inside the sheet. The sheet can further be advantageous in that it can protect the sachet from the surroundings.

The sachet can be gripped within the compartment. The sachet may, for example, have at least two opposite edges arranged in tight contact with two portions of the sheet. This provides a compartment for the sachet which does not require any additional means for holding the sachet inside the sheet. The device is hence easy to produce, and can therefore be produced at a low cost.

By way of example, the sheet forming the compartment for the sachet can be advantageously folded so as to form at least one compartment which is closed on three sides. It is therefore easy to introduce the sachet into the compartment through the open side, after having folded the sheet, without there being a risk of the sachet emerging from the compartment since it abuts against the closed sides of the compartment.

The sheet having the information relating to the product may be made, for example, of paper.

The sachet can be substantially flat. In an illustrated example, the sachet can be produced using two sheets thermally welded to each other. For example, the sheets can be made of a thermoplastic material or of a metalloplastic material, such as an aluminoplastic material. For example, a material including aluminum, polyethylene and polyethylene terephthalate can be utilized. The two sheets may be made of the same material or different materials. For example, one of the sheets can be made of a thermoplastic material and the other of an aluminoplastic material.

According to another aspect, the invention provides an assembly for packaging a product, preferably a cosmetic product, having a container, e.g., in the form of a pot, a tube or a bottle. The container holds a first cosmetic product, and is accommodated in a package, e.g., in the form of a case or box. The assembly further includes a sample package arrangement or device as described above. The device for packaging the sample can be accommodated in the case or the box, for example, on the container.

BRIEF DESCRIPTION OF THE DRAWINGS

The invention will become further apparent from the following detailed description, particularly when considered in conjunction with the drawings in which.

DETAILED DESCRIPTION OF THE PREFERRED EMBODIMENTS

Figure 1:
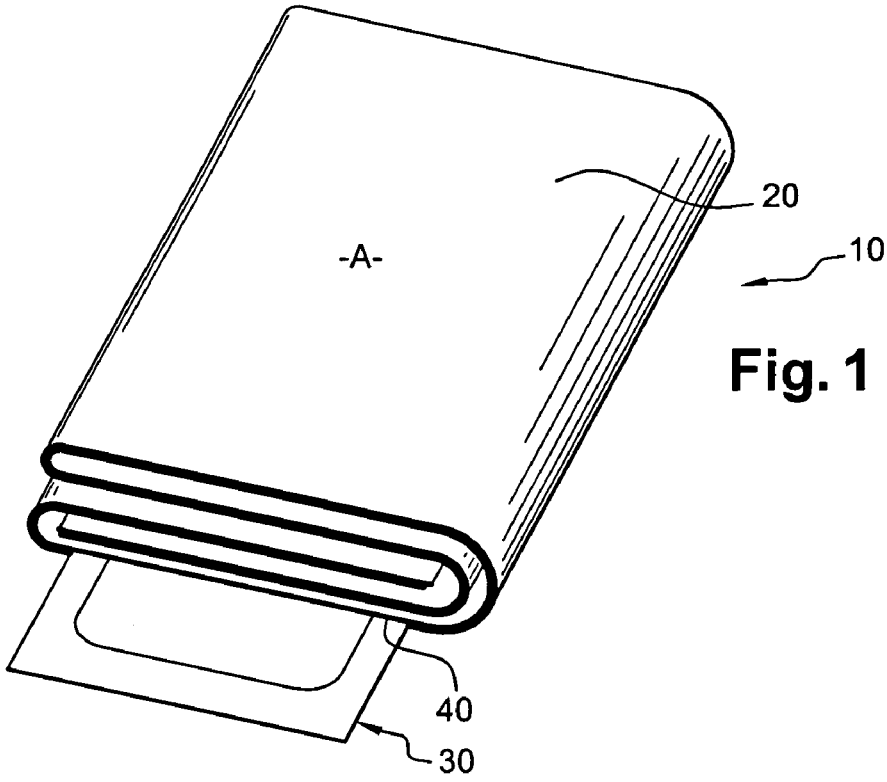
FIG. 1 illustrates a perspective view of a packaging device according to the invention.

The device 10 for packaging a product, preferably in the form of a product sample, which is represented in FIG. 1, includes on the one hand a sheet 20 and, on the other hand, a sachet or packet 30 containing a product $P_2$.

Figure 2:
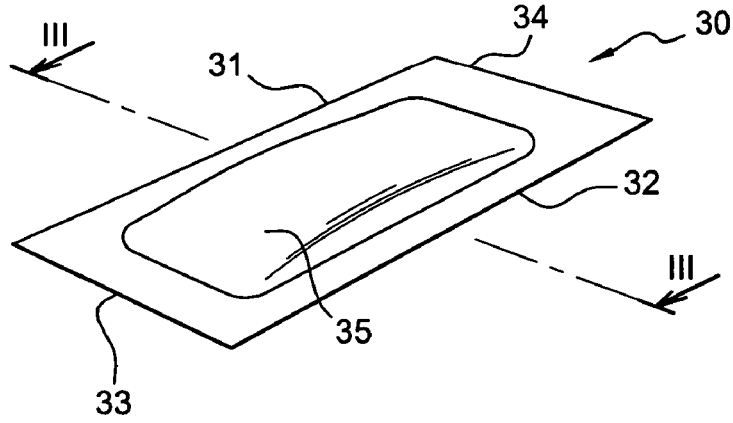
FIGS. 2 and 3 illustrate a sachet containing a sample dose of product.
Figure 3:
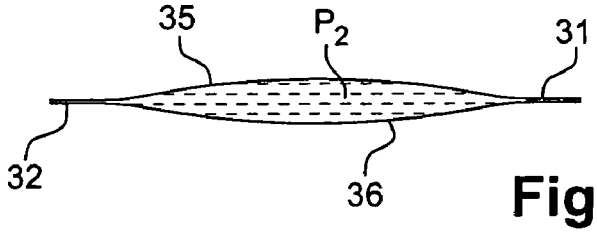

The sachet 30 represented in FIGS. 2 and 3 is substantially flat, and includes two rectangularly shaped sheets 35 and 36, with each of the sheets being formed by an aluminoplastic material, for example a material including aluminum, polyethylene and polyethylene terephthalate. However, as noted earlier, the sheets can be formed of different materials, and both sheets need not be of the same material. Also, the sachet could have different shapes if desired.

The sachet 30 can have, for example, a capacity of about 1 ml. In the preferred form, the product $P_2$ is intended to form a sample dose which is contained inside the sachet. In order to produce the sachet, three edges 31, 32 and 33 of the two sheets 35 and 36 can be thermally welded, and the volume formed in this way can be filled with a dose of product $P_2$. The last side 34 of the sachet can then be thermally welded in order to close the sachet in a leaktight fashion. The last side 34 to be closed may be one of the widths of the sachet, as in the example which is illustrated, or it may be one of the lengths of the sachet. The external face of one or both sheets may optionally be printed beforehand with an indication or information relating to the product $P_2$.

Figure 4:
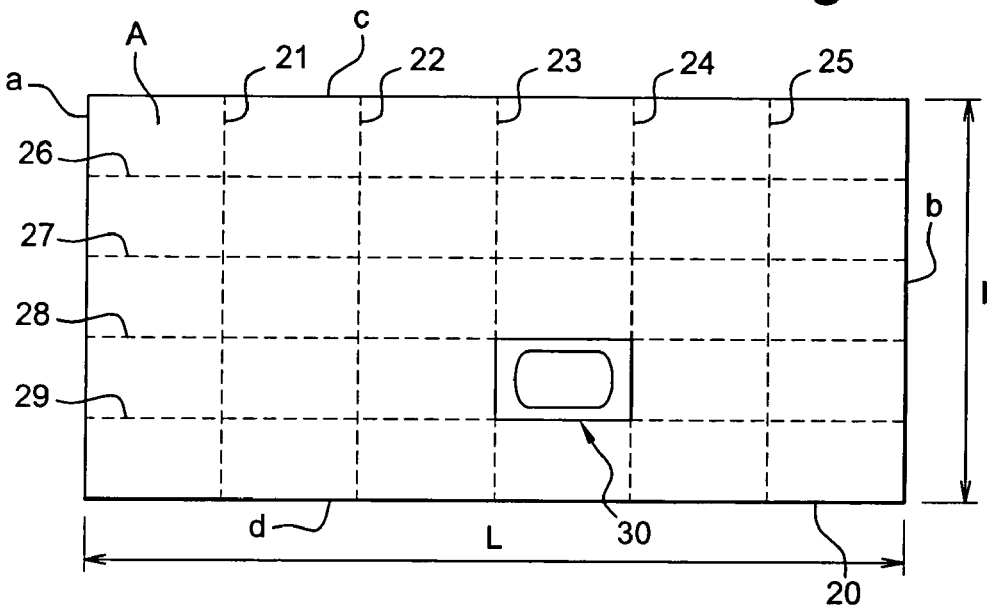
FIG. 4 represents a sheet with fold lines, which is intended to form a compartment for the product sample or sachet.

The sheet 20 represented in FIG. 4 is, for example, a sheet of paper on which information A relating to the product $P_2$ is printed. This information can include information relating to one or more of the identity of the product, its brand or commercial name, a promotional message, the list of ingredients, as well as any information which might be required by law such as the capacity or a measure of the contents, address and code of the packer, etc. The printing can be carried out by any known technique, for example, by screen printing, typography, flexography or offset printing. The sheet 20 can have information on only one of its sides or faces, or alternatively, on both of its sides. As mentioned earlier, the sheet could also include information relating to a product with which the sample will be associated.

In the illustrated example, the sheet 20 is substantially rectangular with a width 1 equal to about 16 cm and a length L equal to about 30 cm. The sheet is folded along a plurality of fold lines, so as to obtain a compact, relatively flat assembly having a small size, formed by a plurality of superimposed layers. Further, by way of example, at least one rectangular compartment 40 is formed between two layers of the sheet, with the compartment closed on three sides 41, 42 and 43.

Figure 5:
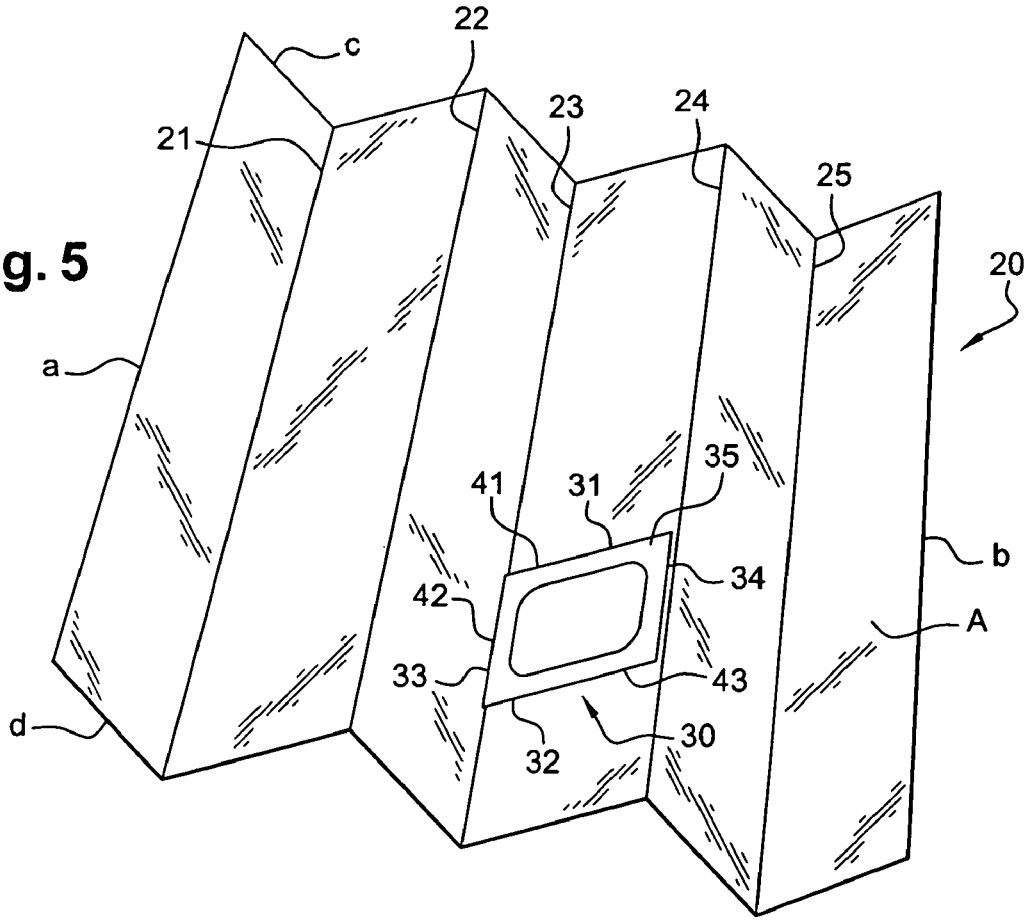
FIGS. 5, 6A, 6B and 6C illustrate the packaging device of FIG. 1 in which the sheet illustrated in FIG. 4 is being folded.
Figure 6A:
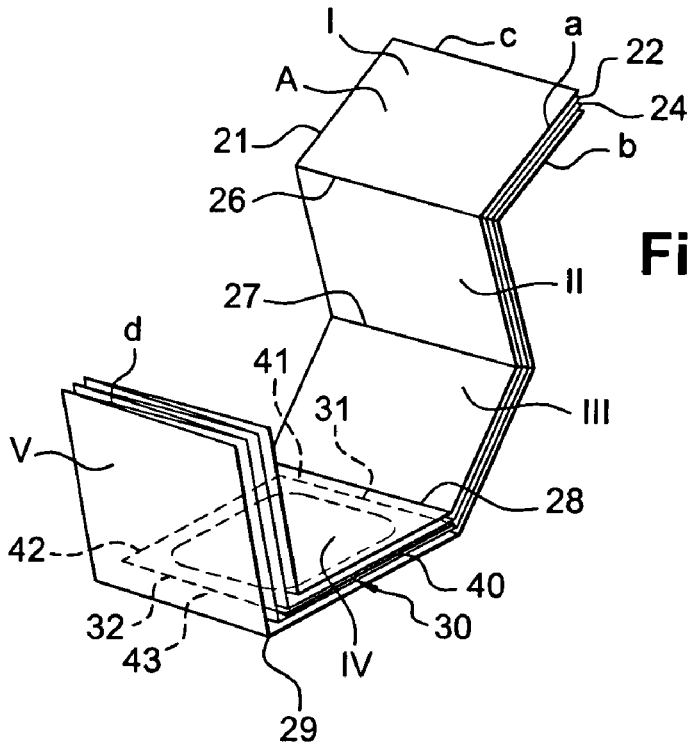
Figure 6B:
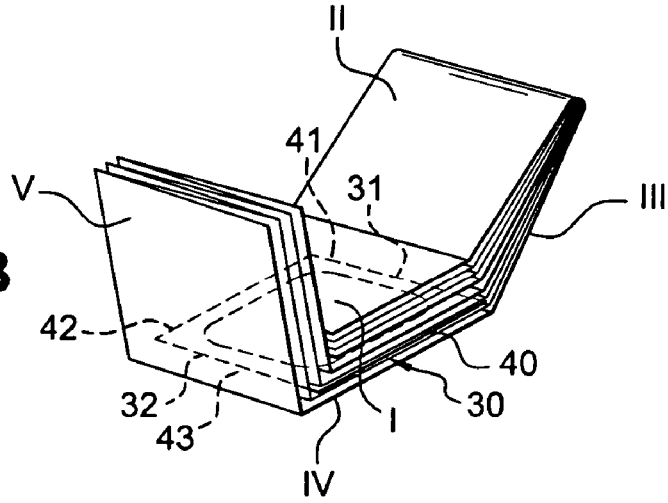
Figure 6C:
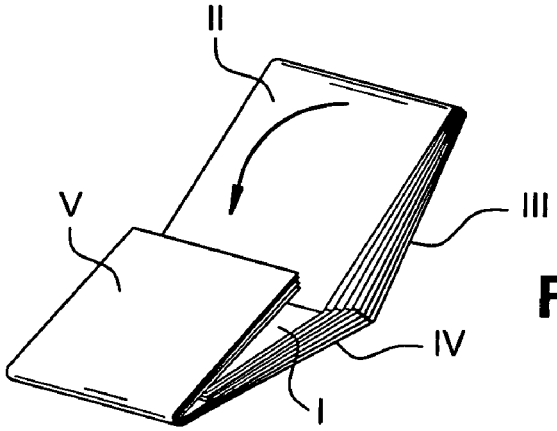

In order to form such an assembly, the sachet 30 is arranged on the sheet 20 as can be seen in FIG. 4. The sheet 20 can then be folded in an accordion or concertina (pleated or zig-zag) fashion along five fold lines 21, 22, 23, 24, 25 which are parallel to one another and to the sheet's edges a and b forming its width 1, as illustrated in FIG. 5. Next, as can be seen in FIG. 6A, the sheet folded in this way can be folded along four fold lines 26, 27, 28 and 29, which are parallel to one another and to the sheet's edges c and d (which form its length L before folding), with each line separating five faces I, II, III, IV and V. As represented in FIGS. 6B and 6C, the faces are folded onto the face IV in which the sachet is accommodated. The last two faces II and V to come in contact with each other may be adhesively bonded together by one or more spots of adhesive, in order to keep a relatively flat assembly while allowing a user to later detach them in order to unfold the sheet. As can be seen in the drawings, with the arrangement illustrated, the substantially flat faces of the sachet can thus be disposed between faces or walls of the compartment formed by the folded sheet. In addition, each face of the sachet can have plural layers of the sheet disposed adjacent thereto formed by folding of the sheet. The provision of plural fold layers forming one or more of the walls of the compartment can be advantageous in enhancing the ability to increase the area with which information can be provided and/or in protecting the sachet.

By way of example, the assembly obtained in this way, which is illustrated in FIG. 1, is rectangularly shaped with a width approximately equal to 3.3 cm and a length approximately equal to 5 cm. The sachet is then contained in a pouch-shaped compartment 40 closed on three sides 41, 42 and 43, with the dimensions of the compartment 40 corresponding substantially to the dimensions of the sachet 30. Two of the sides 41 and 42 delimiting the compartment are thus in tight contact with the edges 31 and 32 of the sachet, so as to wedge it inside the sheet.

Instead of placing the sachet 30 on the sheet 20 before folding the sheet, it is alternatively possible to fold the sheet as described above, and then slide the sachet 30 into the compartment 40.

It is to be understood that the folding of the sheet 20 described above is merely an example, and that the sheets may be folded in different ways or with different configurations. Thus, it is to be understood that alternate fold configurations could be used to form a sheet folded so as to delimit a compartment which can accommodate a sachet. As a variant, for example, the sachet 30 can be arranged in a compartment 40 closed on only two sides 41 and 43, with the sachet being gripped by these two sides. For example, one or more edges of the sachet can be gripped between edges of panels of the sheet forming the compartment by being in tight contact with two portions of the sheet or, e.g., with one or more portions of the sachet extending into or beyond one or more of the folds forming the compartment. The sachet could be gripped within the compartment by other ways if desired. According to another variant, the compartment can be wider and/or longer than the sachet and closed on three sides, or even on four sides with the sachet arranged on the sheet before folding.

Figure 7:
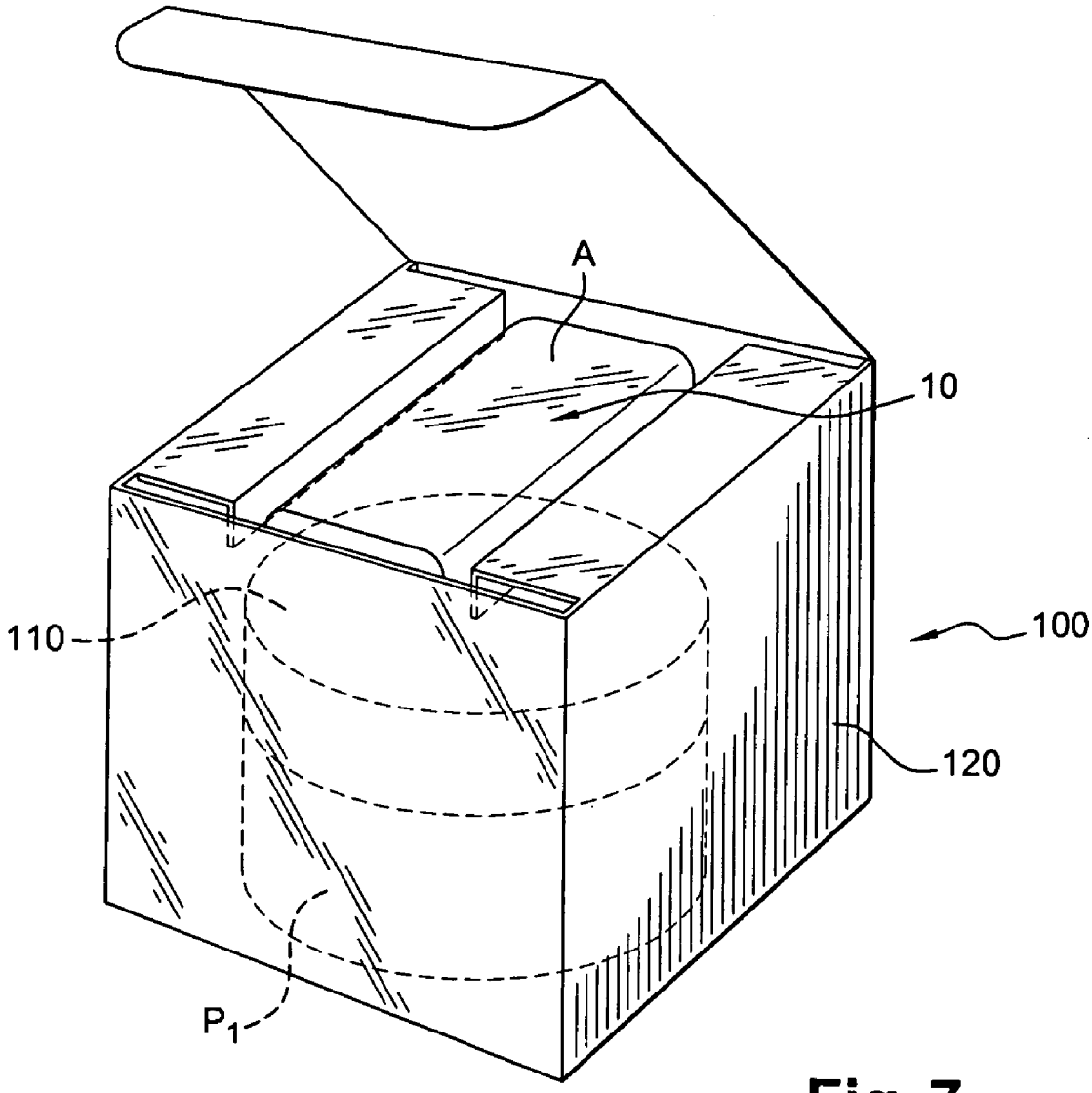
FIG. 7 is a perspective view of a packaging assembly which includes the sample device of FIG. 1.

The packaging device 10 obtained in this way can be included with a packaging assembly 100 that includes an article 110, for example a pot or jar containing a first product $P_1$. The pot 110 is accommodated in packaging 120, for example a cardboard box or other package. The sachet 30 accommodated in the sheet 20 can be introduced into the box 120 on a packaging line used for packaging the assembly 100, either manually or automatically. For example, the sachet and sheet device 10 may be placed on the pot as represented in FIG. 7, or alternatively next to the pot. According to a particular example, the product $P_1$ may be an anti-wrinkle care cream for the face, and the product $P_2$ can be an anti-wrinkle care cream for the contour of the eyes or the region around the eyes. Also, as discussed earlier, the products $P_1$, $P_2$ could be different products, or alternatively can be the same.

When a packaging device 10 for the sample is included with a packaging assembly 100, the information A written on the sheet 20 can relate to the product $P_1$ contained in the pot 110 rather than to the product $P_2$ contained in the sachet or information relating to both can be provided. The sheet 20 may furthermore include information relating to other products in the product range or product line to which the product $P_1$ contained in the pot belongs.

The packaging device 10 can be used to contain any other cosmetic product. By way of a further example, the packaging device 10 can contain a haircare cream, with the device 10 included with a bottle or other container containing a hairdye product.

The device 10 for packaging a product, e.g., a sample, may of course be distributed on its own, that is to say without being included with a packaging assembly 100 containing an additional product article.

In the detailed description above, reference has been made to preferred embodiments and examples of the invention. However, obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A device for packaging a product in the form of a sample, wherein the device can be associated with an article that includes a first cosmetic product, the device including:

a sachet containing a second cosmetic product;

a sheet folded so as to delimit a compartment in which the sachet is accommodated, the sheet including information relating to at least one of the first and second products;

wherein said sheet includes at least two folds, wherein said sachet is removably positioned in said compartment of said sheet, and wherein said sachet can be removed from said sheet without breaking said sheet.

2. A device according to claim 1, wherein the compartment has a shape which is substantially identical to a shape of the sachet.

3. A device according to claim 2, wherein the sachet is gripped within said compartment.

4. A device according to claim 3, wherein the sachet has at least two opposite edges which are arranged in tight contact with two portions of the sheet.

5. A device according to claim 4, wherein the sachet is substantially flat.

6. A device according to claim 5, wherein the sachet includes two sheets thermally welded to each other.

7. A device according to claim 1, wherein the sachet is substantially flat.

8. A device according to claim 7, wherein the sachet includes two sheets thermally welded to each other.

9. A device according to claim 8, wherein at least one of said two sheets includes a thermoplastic material.

10. A device according to claim 8, wherein at least one of the two sheets includes a metalloplastic material.

11. A device according to claim 1, wherein the sheet is folded to form said compartment such that said compartment is closed on three sides.

12. A device according to claim 1, wherein the sheet is made of paper.

13. A device according to claim 1, wherein said sheet includes at least one longitudinal fold and at least one fold extending transverse to said at least one longitudinal fold.

14. A device according to claim 1, wherein said sheet is folded with a plurality of folds forming an accordion fold.

15. A device according to claim 1, wherein said sachet is disposed between at least two walls of said compartment formed by said folded sheet, and wherein at least one of said walls includes plural layers of said sheet.

16. A device according to claim 15, wherein each of said at least two walls includes plural layers of said sheet such that said sachet is disposed between a plurality of layers of said sheet on a first side of said sachet and a plurality of layers of said sheet on a second side of said sachet.

17. A device according to claim 1, wherein said sachet is substantially flat and includes a first substantially flat face and a second substantially flat face, and wherein said compartment includes at least two walls respectively adjacent the first and second substantially flat faces of the sachet, and further wherein at least one of the at least two walls includes plural layers of said sheet formed by folding of said sheet.

18. A device according to claim 17, wherein each of the at least two walls includes plural layers of said sheet.

19. A device according to claim 1, wherein said sachet has a first wall and a second wall, each in contact with said sheet.

20. A device according to claim 19, wherein said first wall and said second wall are not formed from said sheet.

21. A device according to claim 1, wherein said sachet is removably held in said compartment of said sheet, and wherein said sachet can be removed without breaking of said sheet and without breaking of said sachet.

22. A device according to claim 1, wherein the sachet is formed of a different material than said sheet.

23. A device according to claim 21, wherein said sheet includes paper.

24. A packaging assembly comprising:

a package;

a container containing a first cosmetic product, wherein said container is disposed in said package;

a sachet containing a second cosmetic product;

a sheet folded so as to delimit a compartment in which the sachet is accommodated, the sheet including information relating to at least one of the first and second products; and wherein said sheet with said sachet accommodated therein is positioned inside of said package containing said container to form the packaging assembly.

25. An assembly according to claim 24, wherein said sheet having said sachet accommodated therein is in a common compartment of said package as said container.

26. An assembly according to claim 25, wherein said sheet is next to said container in said package.

27. An assembly according to claim 25, wherein said sheet having the sachet accommodated therein is positioned on top of said container in said package.

28. An assembly according to claim 19, wherein said container is in the form of one of a pot, a tube, and a bottle, and wherein the package that contains said container is in the form of one of a case and a box.

29. An assembly according to claim 24, wherein said container is in the form of one of a pot, a tube, and a bottle, and wherein the package that contains said container is in the form of one of a case and a box.

30. An assembly according to claim 24, wherein the first and second cosmetic products are the same product.

31. An assembly according to claim 24, wherein the first and second cosmetic products are different products.

32. An assembly according to claim 24, wherein the first and second cosmetic products are both creams.

33. An assembly according to claim 32, wherein said first cosmetic product is an anti-wrinkle cream and said second cosmetic product is an anti-wrinkle cream which is different from that of the first cosmetic product.

34. An assembly according to claim 24, wherein said first and second cosmetic products are hair products.

35. An assembly according to claim 34, wherein the first cosmetic product is different than the second cosmetic product.

36. A device for packaging a product in the form of a sample, wherein the device can be associated with an article that includes a first cosmetic product, the device including:

a sachet containing a second cosmetic product;

a sheet folded so as to delimit a compartment in which the sachet is accommodated, the sheet including information relating to at least one of the first and second products;

wherein said sheet includes at least two folds;

wherein said sheet is folded with a plurality of folds forming an accordion fold; and wherein said sheet further includes a plurality of folds extending transverse to said plurality of folds forming the accordion fold.

37. A device for packaging a product in the form of a sample, wherein the device can be associated with an article that includes a first cosmetic product, the device including:

a sachet containing a second cosmetic product;

a sheet folded so as to delimit a compartment in which the sachet is accommodated, the sheet including information relating to at least one of the first and second products;

wherein said sheet includes at least two folds;

further including a package and the article disposed in said package, and wherein said article includes a container containing the first cosmetic product, and further wherein said device is disposed inside of said package, and further wherein said sheet includes at least one longitudinal fold and at least one fold extending transverse to said at least one longitudinal fold.

* * * * *

UNITED STATES PATENT AND TRADEMARK OFFICE

CERTIFICATE OF CORRECTION

PATENT NO. : 7,316,310 B2
APPLICATION NO. : 10/855337
DATED : January 8, 2008
INVENTOR(S) : Ira Saschin It is certified that error appears in the above-identified patent and that said Letters Patent is hereby corrected as shown below:

Title page, item (57), Abstract, line 8, change “packing” to --packaging--.

Signed and Sealed this

Twenty-first Day of October, 2008

JON W. DUDAS
*Director of the United States Patent and Trademark Office*